US011761444B2

(12) United States Patent
Tomkins et al.

(10) Patent No.: US 11,761,444 B2
(45) Date of Patent: Sep. 19, 2023

(54) VACUUM PUMP COOLER FOR COOLING A PUMPED FLUID IN A MULTISTAGE VACUUM PUMP

(71) Applicant: Edwards Limited, Burgess Hill (GB)

(72) Inventors: Mark Edward Tomkins, Burgess Hill (GB); Andrew John Hunt, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 0 days.

(21) Appl. No.: 17/851,362

(22) Filed: Jun. 28, 2022

(65) Prior Publication Data

US 2022/0412361 A1 Dec. 29, 2022

(30) Foreign Application Priority Data

Jun. 29, 2021 (GB) ..... 2109341

(51) Int. Cl.

| | |
|---|---|
| ***F04C 29/04*** | (2006.01) |
| ***F04C 18/12*** | (2006.01) |
| ***F04C 23/00*** | (2006.01) |
| ***F01C 21/10*** | (2006.01) |

(52) U.S. Cl.

CPC ..... *F04C 29/04* (2013.01); *F04C 18/126* (2013.01); *F04C 23/001* (2013.01); *F04C 2220/10* (2013.01); *F04C 2240/30* (2013.01)

(58) Field of Classification Search

CPC ..... F04C 29/04; F04C 18/126; F04C 23/001; F04C 2240/30; F01C 21/104

See application file for complete search history.

(56) References Cited

U.S. PATENT DOCUMENTS

| | | | | |
|---|---|---|---|---|
| 2010/0119399 | A1* | 5/2010 | Dowdeswell | F04C 18/126 418/9 |
| 2013/0044497 | A1* | 2/2013 | Sakamoto | G02B 6/0065 362/311.06 |
| 2016/0020187 | A1* | 1/2016 | Okada | H01L 23/3121 156/60 |
| 2019/0194804 | A1* | 6/2019 | Cho | H01L 21/67098 |

FOREIGN PATENT DOCUMENTS

| | | | | |
|---|---|---|---|---|
| CN | 210196023 | U | 3/2020 | |
| DE | 0459116 | A1 * | 12/1991 | F04C 23/008 |
| EP | 2071191 | A2 | 6/2009 | |
| JP | H0419385 | A | 1/1992 | |
| WO | WO-2012158289 | A1 * | 11/2012 | H01L 23/36 |

OTHER PUBLICATIONS

English translation of WO2012158289 by PE2E Oct. 21, 2022.*
English translation of EP0459116 by PE2E Feb. 13, 2023.*
English translation of WO2012158289 by PE2E May 18, 2023.*
British Examination Report dated Dec. 17, 2021 and Search Report dated Dec. 16, 2021 for corresponding British application Serial No. GB2109341.4, 6 pages.

* cited by examiner

*Primary Examiner* — Deming Wan
(74) *Attorney, Agent, or Firm* — Theodore M. Magee; Westman, Champlin & Koehler, P.A

(57) ABSTRACT

A vacuum pump cooler for cooling a pumped fluid in a multistage vacuum pump, the vacuum pump cooler comprising: a plate comprising: a first surface; a second surface opposite to the first surface; and a channel through which a cooling fluid can flow; and one or more fins extending from the second surface of the plate.

14 Claims, 5 Drawing Sheets

VACUUM PUMP COOLER FOR COOLING A PUMPED FLUID IN A MULTISTAGE VACUUM PUMP

CROSS-REFERENCE OF RELATED APPLICATION

This application claims priority of British Application No. 2109341.4, filed Jun. 29, 2021.

FIELD

The present invention relates to vacuum pump coolers for cooling pumped fluids in multistage vacuum pumps.

BACKGROUND

Vacuum pumps are used in various technical processes to pump gases out of process chambers, thereby to create low-pressure conditions for the respective processes.

In multistage vacuum pumps, gas is pumped through successive pumping stages.

The discussion above is merely provided for general background information and is not intended to be used as an aid in determining the scope of the claimed subject matter. The claimed subject matter is not limited to implementations that solve any or all disadvantages noted in the background.

SUMMARY

As a fluid is pumped through sequential stages of a multistage vacuum pump, the temperature of the pumped fluid tends to be increased. This may, for example, result from the working (e.g., compression) of the fluid by the pumping mechanism of the pump.

Managing the thermal load within a multistage vacuum pump tends to be critical in, for example, maintaining a good working temperature, maintaining correct clearances within the pump, and ensuring various components and working fluids operate as desired. Poor thermal management can lead to loss of pumping performance and reliability.

Conventionally, the external body of a vacuum pump is cooled to attempt to remove heat that results from compression of the pumped fluid.

The present inventors have realised that more effective cooling can be achieved by cooling the pumped fluid in the interstage areas where fluid passes from one stage to another. Such cooling may be considered to be "intercooling".

Aspects of the invention provide vacuum pump coolers and vacuum pumps that provide for intercooling of the pumped fluid thereby to provide improved cooling effectiveness and, thus, improved pumping performance and reliability.

In an aspect, there is provided a vacuum pump cooler for cooling a pumped fluid in a multistage vacuum pump. The vacuum pump cooler comprises a plate comprising a first surface, a second surface opposite to the first surface, and a channel through which a cooling fluid can flow. The vacuum pump cooler further comprises one or more fins extending from the second surface of the plate.

The vacuum pump cooler may comprise a plurality of fins.

The channel may be defined, at least in part, by a recess formed in the first surface.

The channel may define a meandering pathway.

At least a part of the channel may be formed in the one or more fins.

One or more of the one or more fins may have a substantially U-shaped cross-section.

The plate may further comprise one or more ports, each port being configured to receive a respective blow-off valve.

The plate may further comprise an aperture extending between the first surface and the second surface, the aperture defining an inlet or outlet of the vacuum pump.

The vacuum pump cooler may be a single unitary item.

The vacuum pump cooler may be formed from a material selected from the group of materials consisting of iron, alloys of iron, steel, anodised aluminium, and alloys of aluminium.

In a further aspect, there is provided a multistage vacuum pump comprising: a first stage having a first pumping chamber, the first pumping chamber having a first inlet and a first outlet; a second stage having a second pumping chamber, the second pumping chamber having a second inlet and a second outlet; an interstage duct fluidly coupling the first outlet and the second inlet; and a vacuum pumping cooler according to any of claims 1 to 10, wherein the vacuum pump cooler is arranged such that the one or more fins extend into the interstage duct.

The multistage vacuum pump may further comprise a further vacuum pumping cooler, the further vacuum pumping cooler being a vacuum pumping cooler according to any preceding aspect, wherein the further vacuum pump cooler is arranged such that the one or more fins of the further vacuum pumping cooler extend into the interstage duct.

The vacuum pumping cooler and the further vacuum pumping cooler may define opposite walls of a housing that houses the first stage, the second stage, and the interstage duct.

The vacuum pumping cooler may comprise a first aperture extending between the first surface and the second surface of the vacuum pumping cooler, the first aperture defining an inlet of the multistage vacuum pump. The further vacuum pumping cooler may comprise a second aperture extending between the first surface and the second surface of the further vacuum pumping cooler, the second aperture defining an outlet of the multistage vacuum pump.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DETAILED DESCRIPTION

It will be appreciated that relative terms such as above and below, horizontal and vertical, top and bottom, front and back, and so on, are used herein merely for ease of reference to the Figures, and these terms are not limiting as such, and any two differing directions or positions and so on may be implemented rather than truly above and below, horizontal and vertical, top and bottom, and so on.

Figure 1:
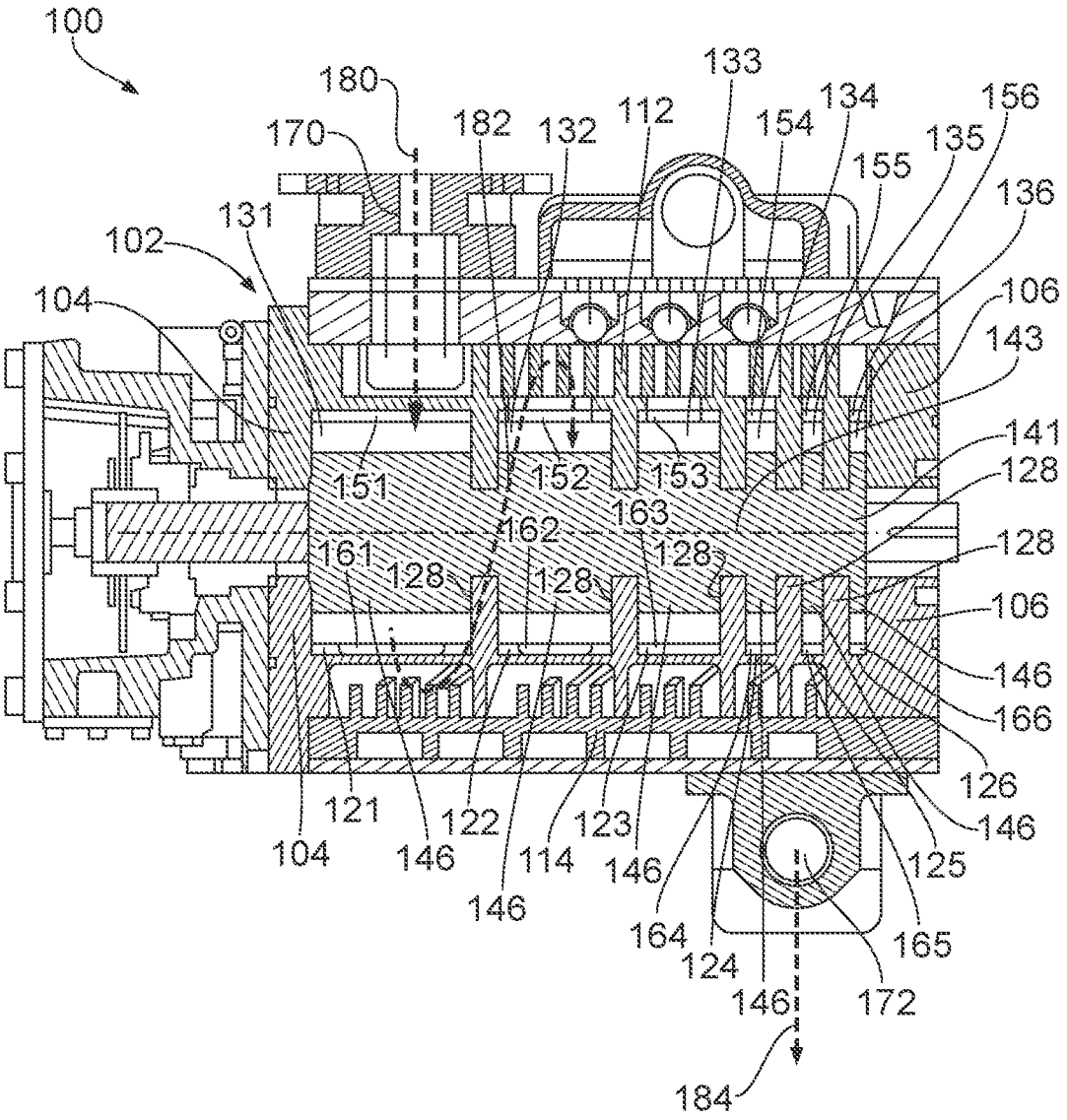
FIG. 1 is a schematic illustration (not to scale) showing a side view cross section of a vacuum pump.

FIG. 1 is a schematic illustration (not to scale) showing a side view cross section of a multistage vacuum pump 100.

Figure 2:
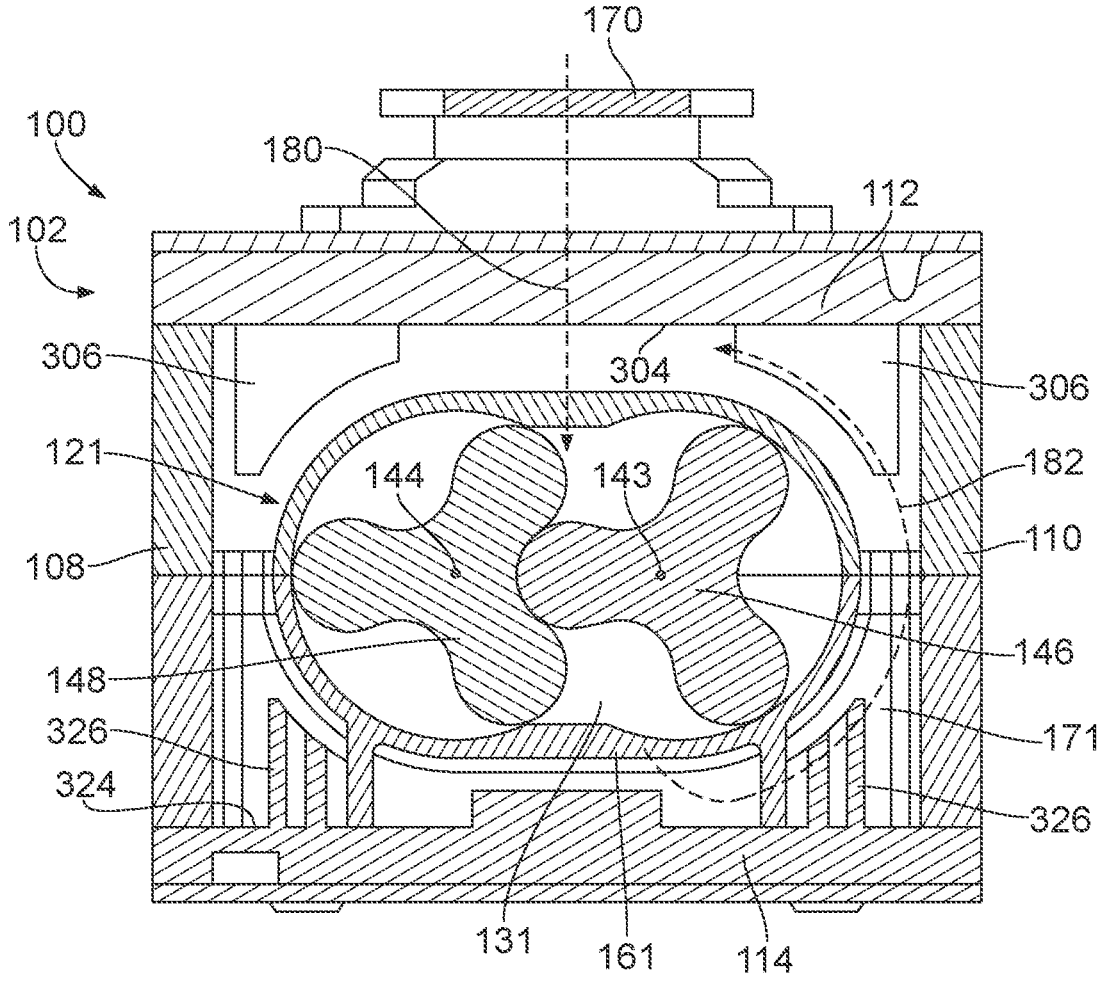
FIG. 2 is a schematic illustration (not to scale) showing a front view cross section of the vacuum pump.

FIG. 2 is a schematic illustration (not to scale) showing a front view cross section of the multistage vacuum pump 100.

In this embodiment, the multistage vacuum pump 100 is a Roots vacuum pump.

In this embodiment, the multistage vacuum pump 100 comprises a housing 102. The housing 102 comprises an upstream end wall 104, a downstream end wall 106 opposite to the upstream end wall 104, a first side wall 108, a second side wall 110 opposite to the first side wall 108, a first vacuum pump cooler 112, and a second vacuum pump cooler 114. The first vacuum pump cooler 112 forms a top or upper wall of the housing 102. The second vacuum pump cooler 114 forms a bottom or lower wall of the housing 102. The second vacuum pump cooler 114 is positioned opposite to the first vacuum pump cooler 112.

The first vacuum pump cooler 112 and the second vacuum pump cooler 114, and their functionality, will be described in more detail later below with reference to FIGS. 3 and 4.

The housing 102 defines a plurality of pumping stages, namely a first pumping stage 121, a second pumping stage 122, a third pumping stage 123, a fourth pumping stage 124, a fifth pumping stage 125, and a sixth pumping stage 126. The pumping stages 121-126 of the multistage vacuum pump 100 are defined by partition walls 128 within the housing 102. The partition walls 128 may, for example, be integral with one or more of the upstream end wall 104, the downstream end wall 106, the first side wall 108, and the second side wall 110.

For each pumping stage 121-126, the housing 102 defines a respective stator comprising a stator bore. Thus, the housing defines a first stator bore 131, a second stator bore 132, a third stator bore 133, a fourth stator bore 134, a fifth stator bore 135, and a sixth stator bore 136.

The multistage vacuum pump 100 comprises a rotor assembly comprising two shafts, namely a first shaft 141 and a second shaft 142. The two shafts 141, 142 are configured to rotate in opposite directions about parallel axes of rotation. The first shaft 141 is configured to rotate about a first axis of rotation 143. The second shaft 142 is configured to rotate about a second axis of rotation 144.

Each shaft 141, 142 comprises a plurality of rotors. Each rotor of each shaft 141, 142 is located within a respective one of the stator bores 131-136. Thus, each stator bore 131-136 has located within it a respective pair of rotors, each rotor of the pair of rotors being mounted to a respective one of the two shafts 141, 142.

FIG. 1 shows a plurality of first rotors 146, each first rotor 146 being located in a respective stator bore 131, 136. FIG. 2 shows a pair of rotors, namely a first rotor 146 and a second rotor 148, located in the first stator bore 131.

Each of the rotors 146, 148 is a three-lobed rotor.

For each stator bore 131-136, the pair of rotors 146, 148 located therein are cooperating rotors configured to rotate within that stator bore 131-136. For each stator bore 131-136, the rotors 146, 148 mounted therein have cooperating dimensions with that stator bore 131-136 such that an outer edge of each rotor 146, 148 that is remote from the other rotor 146, 148 seals with the stator bore 131-136 when rotating within the stator bore 131-136.

Each of the stator bores 131-136 comprises a respective inlet and a respective outlet. In particular, in this embodiment, the first stator bore 131 comprises a first inlet 151 and a first outlet 161, the second stator bore 132 comprises a second inlet 152 and a second outlet 162, the third stator bore 133 comprises a third inlet 153 and a third outlet 163, the fourth stator bore 134 comprises a fourth inlet 154 and a fourth outlet 164, the fifth stator bore 135 comprises a fifth inlet 155 and a fifth outlet 165, and the sixth stator bore 136 comprises a sixth inlet 156 and a sixth outlet 166.

The multistage vacuum pump 100 comprises a plurality of interstage ducts that fluidly connect together the pumping stages 121-126 and permit fluid flow through successive pumping stages 121-126. In this embodiment the interstage ducts pass around an external surface of the stators. A first interstage duct (indicated in FIG. 2 by the reference numeral 171) fluidly connects the first outlet 161 to the second inlet 152. Also, a second interstage duct fluidly connects the second outlet 162 to the third inlet 153. Also, a third interstage duct fluidly connects the third outlet 163 to the fourth inlet 154. Also, a fourth interstage duct fluidly connects the fourth outlet 164 to the fifth inlet 155. Also, a fifth interstage duct fluidly connects the fifth outlet 165 to the sixth inlet 156.

The multistage vacuum pump 100 comprises a pump inlet 170 and a pump outlet 172. The pump inlet 170 is connected to the first inlet 151 of the first stator bore 131. The pump outlet 172 is connected to the sixth outlet 166 of the sixth stator bore 136.

In operation, the shafts 141, 142 are rotated (for example, by an electric motor) thereby causing rotation of the rotors 146, 148 within the stator bores 131-136. Rotation of the rotors 146, 148 within the first stator bore 131 draws gas into the first stator bore 131 via the pump inlet 170 and the first inlet 151. This flow of gas into the multistage vacuum pump 100 is shown in FIGS. 1 and 2 by dashed arrows and the reference numeral 180. Continued rotation of the rotors 146, 148 within the stator bores 131-136 moves gas through successive pumping stages 121-126 via the interstage ducts. In particular, in this embodiment, the pumped gas is pumped through the multistage vacuum pump 100 as follows: the gas is pumped out of the first stator bore 131 via the first outlet 161, and through the first interstage duct 171 to the second inlet 152, via which it enters the second stator bore 132 (this flow of gas is indicated in FIGS. 1 and 2 by a dashed arrow and the reference numeral 182); the gas is then pumped out of the second stator bore 132 via the second outlet 162, and through a second interstage duct to the third inlet 153, via which it enters the third stator bore 133; the gas is then pumped out of the third stator bore 133 via the third outlet 163, and through a third interstage duct to the fourth inlet 154, via which it enters the fourth stator bore 134; the gas is then pumped out of the fourth stator bore 134 via the fourth outlet 164, and through a fourth interstage duct to the fifth inlet 155, via which it enters the fifth stator bore 135; the gas is then pumped out of the fifth stator bore 135 via the fifth outlet 165, and through a fifth interstage duct to the sixth inlet 156, via which it enters the sixth stator bore 136; the gas is then pumped out of the sixth stator bore 136 via the sixth outlet 166, and out of the pump 100 via the pump outlet 172. This flow of gas out of the multistage vacuum pump 100 is shown in FIG. 1 by a dashed arrow and the reference numeral 184.

Figure 3:
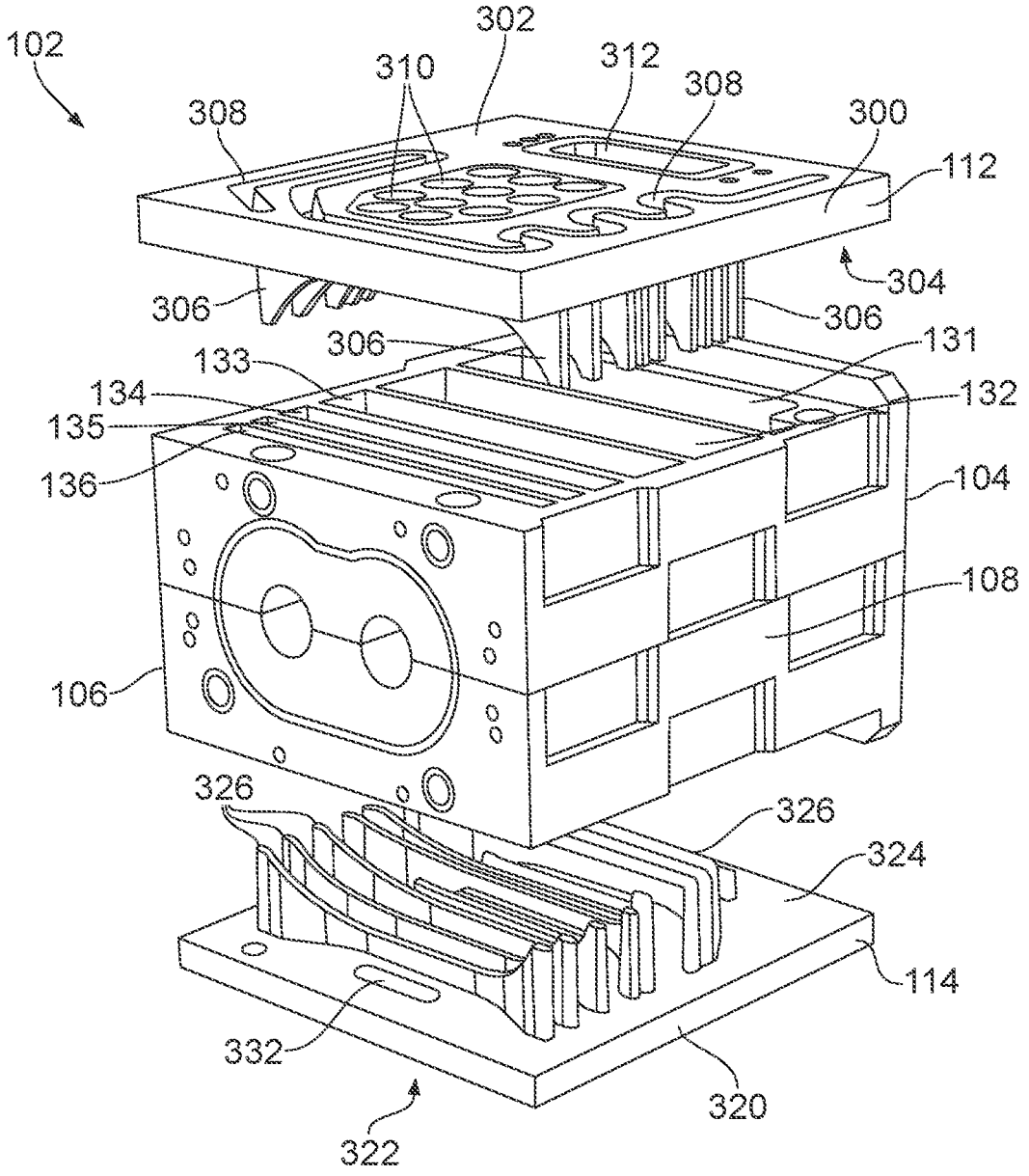
FIG. 3 is a schematic illustration (not to scale) showing an exploded perspective view of a housing of the vacuum pump.

FIG. 3 is a schematic illustration (not to scale) showing an exploded perspective view of the housing 102.

Figure 4:
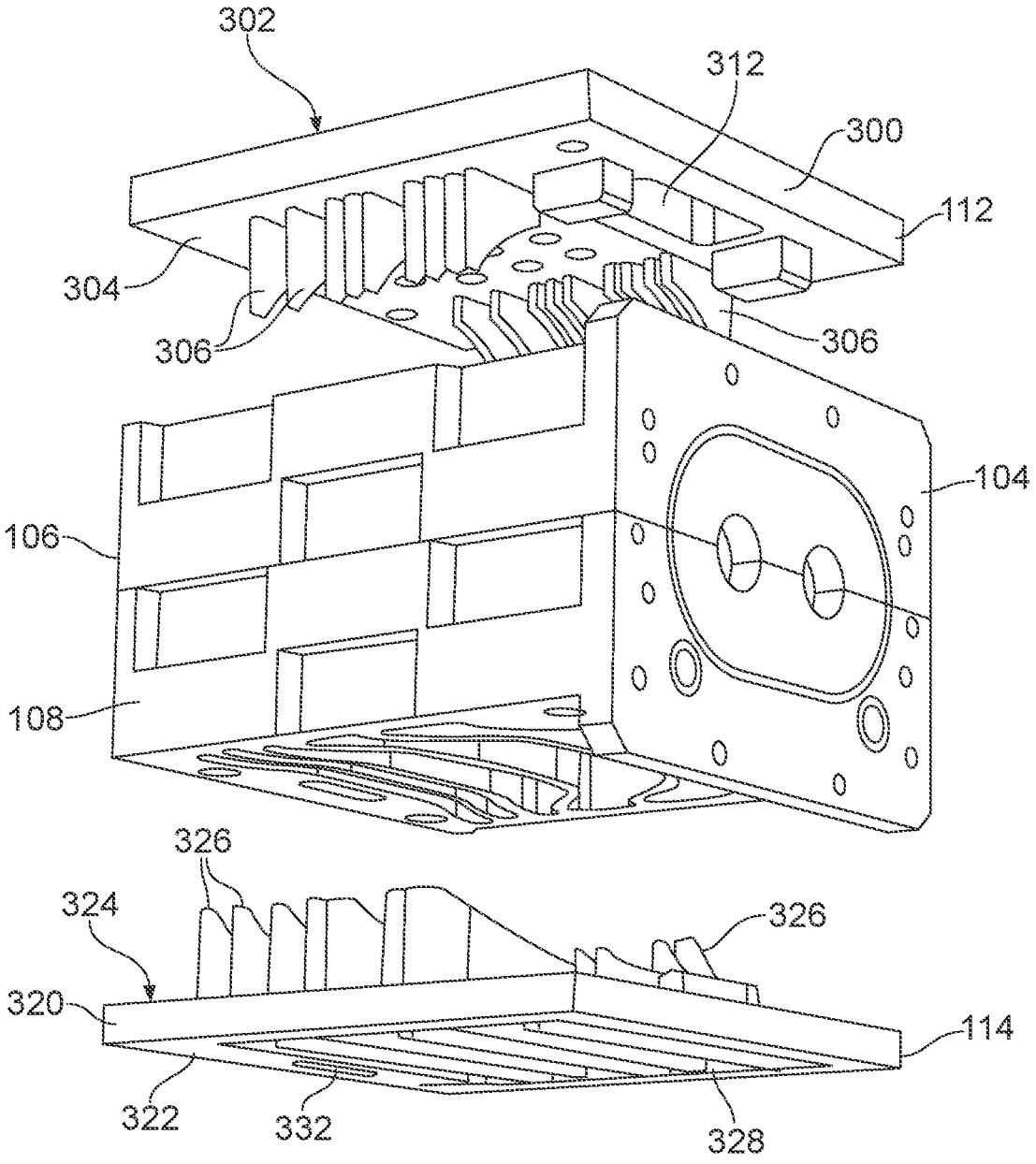
FIG. 4 is a schematic illustration (not to scale) showing a further exploded perspective view of the housing of the vacuum pump.

FIG. 4 is a schematic illustration (not to scale) showing a further exploded perspective view of the housing 102.

In this embodiment, the first vacuum pump cooler 112 forms a top wall of the housing 102. The first vacuum pump cooler 112 is attached to a top surface of the assembly, the assembly comprising the upstream end wall 104, the downstream end wall 106, the first side wall 108, and the second side wall 110. The first vacuum pump cooler 112 may be attached to the assembly by any appropriate means, such as by using a plurality of fasteners.

The first vacuum pump cooler 112 comprises a first plate 300 having a first surface 302 and a second surface 304 opposite to the first surface 302.

In this embodiment, the first surface 302 is a top surface of the first plate 300 and the second surface 304 is a bottom surface of the first plate 300. When the first vacuum pump cooler 112 is attached to the top surface of the assembly, the first surface 302 forms an external surface of the housing 102. Also, the second surface 304 of the first plate 300 contacts the top edges of the upstream end wall 104, the downstream end wall 106, the first side wall 108, and the second side wall 110. The second surface 304 of the first plate 300 may be sealed against the top edges of the upstream end wall 104, the downstream end wall 106, the first side wall 108, and the second side wall 110, for example by means of an O-ring or sealing gasket disposed therebetween.

The first vacuum pump cooler 112 further comprises a plurality of first fins 306 extending downwards from the second surface 304 of the first plate 300. In this embodiment, there are eight first fins 306. Preferably, the first fins 306 are integrally formed with the first plate 300. This tends to reduce or eliminate air gaps or joints between the first fins 306 and the first plate 300 to provide for improved thermal conductivity and improved transfer of heat therebetween.

When the first vacuum pump cooler 112 is attached to the top surface of the assembly to form the upper wall of the housing 102, the first fins 306 extend into the interstage ducts. One or more first fins 306 may extend into each of the interstage ducts. More preferably, a plurality of first fins 306 extends into each of the interstage ducts. As shown in FIG. 2, at least one first fin 306 extends downwards from the second surface 304 of the first plate 300 into the first interstage duct 171.

In this embodiment, when viewed from the front, the first fins 306 appear to be substantially U-shaped fins, i.e. may be considered to have substantially U-shaped cross-section. This may allow the first fins 306 to extend through the interstage ducts around both sides of the stators. In some embodiments, when viewed from below, the first fins 306 may appear to be substantially U-shaped fins, i.e. may be considered to have substantially U-shaped cross-sections. This may allow the first fins 306 to extend along the interstage ducts. The shapes of the first fins 306 may be application dependent, and may depend on the size and shape of the interstage ducts through which the first fins 306 extend when the housing 102 is assembled.

The first plate 300 comprises a first channel 308. The first channel 308 is a channel through which a cooling fluid can flow. In this embodiment, the first channel 308 is defined by a recess formed in the first surface 302 of the first plate 300. In this embodiment, the first channel 308 defines a meandering or convoluted pathway over the first surface 302 of the first plate 300. In some embodiments, the first channel may be comprised of one or more voids or cavities.

In this embodiment, the first plate 300 comprises a plurality of ports 310. Each port 310 is an aperture extending through the first plate 300 from the first surface 302 to the second surface 304. Each port 310 is configured to receive a respective blow-off valve.

In this embodiment, in the assembled multistage vacuum pump 100, a plurality of blow-off valves is provided. Each blow-off valve is disposed in a respective one of the plurality of ports 310. The one or more blow-off valves are a pressure relief system configured to relieve pressure in the stator bores 131-136 of the multistage vacuum pump 100. The one or more blow-off valves are configured to adopt closed positions when the pressure in one or more of the stator bores 131-136 is less than a threshold pressure, thereby preventing or opposing gas flow therethrough. Also, the one or more blow-off valves are configured to open when the pressure in one or more of the stator bores 131-136 is greater than or equal to the threshold pressure, thereby allowing gas flow out of the one or more stator bores 131-136 to the external atmosphere. In this way, a pressure within the multistage vacuum pump 100 may be relieved. This advantageously tends to reduce load on the rotors 146, 148 and prevent over-compression of the gas being pumped.

In this embodiment, the first plate 300 further comprises a first aperture 312. The first aperture 312 extends through the first plate 300 from the first surface 302 to the second surface 304. The first aperture 312 fluidly connects the pump inlet 170 to the first inlet 151. Thus, the first aperture 312 may be considered to, at least partially, define an inlet of the multistage vacuum pump 100. In operation, gas is pumped into the pump inlet 170, through the first aperture 312, and then through the first inlet 151 to the first stator bore 131.

In this embodiment, the first vacuum pump cooler 112 is a single unitary item. The first vacuum pump cooler 112 may be a monolithic part or product. As used herein, the term "monolithic" may mean comprising a substantially single unit which, in some embodiments, may be a single piece formed, composed, or created without joints or seams and comprising a substantially uniform, but not necessarily rigid, whole. The first vacuum pump cooler 112 may be undifferentiated, i.e. formed of a single material, which may be substantially homogenous throughout that part.

The first vacuum pump cooler 112 is formed from a thermally conductive material, such as a material selected from the group of materials consisting of iron, alloys of iron, steel, anodised aluminium, and alloys of aluminium.

The first vacuum pump cooler 112 may be manufactured by any appropriate manufacturing technique including, but not limited to, machining from a solid workpiece or blank, casting, or by additive manufacturing.

In this embodiment, the second vacuum pump cooler 114 forms a bottom wall of the housing 102, opposite to the top wall formed by the first vacuum pump cooler 112. The second vacuum pump cooler 114 is attached to a bottom surface of the assembly, the assembly comprising the upstream end wall 104, the downstream end wall 106, the second side wall 108, and the second side wall 110. The second vacuum pump cooler 114 may be attached to the assembly by any appropriate means, such as by using a plurality of fasteners.

The second vacuum pump cooler 114 comprises a second plate 320 having a first surface 322 and a second surface 324 opposite to the first surface 322.

In this embodiment, the first surface 322 is a bottom surface of the second plate 300 and the second surface 324 is a top surface of the second plate 320. When the second vacuum pump cooler 114 is attached to the bottom surface of the assembly, the first surface 322 forms an external surface of the housing 102. Also, the second surface 324 of the second plate 320 contacts the bottom edges of the upstream end wall 104, the downstream end wall 106, the first side wall 108, and the second side wall 110. The second surface 324 of the second plate 320 may be sealed against the bottom edges of the upstream end wall 104, the downstream end wall 106, the first side wall 108, and the second side wall 110, for example by means of an O-ring or sealing gasket disposed therebetween.

The second vacuum pump cooler 114 further comprises a plurality of second fins 326 extending upwards from the second surface 304 of the second plate 300. In this embodiment, there are thirteen second fins 306. Preferably, the second fins 326 are integrally formed with the second plate 320. This tends to reduce or eliminate air gaps or joints between the second fins 326 and the second plate 320 to provide for improved thermal conductivity and improved transfer of heat therebetween.

When the second vacuum pump cooler 114 is attached to the bottom surface of the assembly to form the lower wall of the housing 102, the second fins 326 extend into the interstage ducts. One or more second fins 326 may extend into each of the interstage ducts. More preferably, a plurality of second fins 326 extends into each of the interstage ducts. As shown in FIG. 2, at least one second fin 326 extends upwards from the second surface 324 of the second plate 320 into the second interstage duct 171.

In this embodiment, when viewed from the front, the second fins 326 appear to be substantially U-shaped fins, i.e. may be considered to have substantially U-shaped cross-section. This may allow the second fins 326 to extend through the interstage ducts around both sides of the stators. In some embodiments, when viewed from above, the second fins 326 may appear to be substantially U-shaped fins, i.e. may be considered to have substantially U-shaped cross-section. This may allow the second fins 326 to extend along the interstage ducts. The shapes of the second fins 326 may be application dependent, and may depend on the size and shape of the interstage ducts through which the second fins 326 extend when the housing 102 is assembled.

The second plate 320 comprises a second channel 328. The second channel 328 is a channel through which a cooling fluid can flow. In this embodiment, the second channel 328 is defined by a recess formed in the first surface 322 of the second plate 320. In this embodiment, the second channel 328 defines a meandering or convoluted pathway over the first surface 322 of the second plate 320.

In this embodiment, the second plate 320 further comprises a second aperture 332. The second aperture 332 extends through the second plate 320 from the first surface 322 to the second surface 324. The second aperture 332 fluidly connects the pump outlet 172 to the sixth outlet 166. Thus, the second aperture 332 may be considered to, at least partially, define an outlet of the multistage vacuum pump 100. In operation, gas is pumped out of the sixth stator bore 136 through the sixth outlet 166, through the second aperture 332, and then out through the pump outlet 172.

In this embodiment, the second vacuum pump cooler 114 is a single unitary item. The second vacuum pump cooler 114 may be a monolithic part or product.

The second vacuum pump cooler 114 is formed from a thermally conductive material, such as a material selected from the group of materials consisting of iron, alloys of iron, steel, anodised aluminium, and alloys of aluminium.

The second vacuum pump cooler 114 may be manufactured by any appropriate manufacturing technique including, but not limited to, machining from a solid workpiece or blank, casting, or by additive manufacturing.

In operation, gas is pumped through successive stages 121-126 of the multistage vacuum pump 100, as described in more detail earlier above. The pumped gas travels between successive stages 121-126 of the pump 100 via interstage ducts, such as the first duct 171. As the pumped gas travels through the interstage ducts, it travels over (i.e. contacts) the first fins 306 and the second fins 326 that are located within the interstage ducts. As the pumped gas travels over the first and second fins 306, 326, heat from the gas is transferred to the fins 306, 326. Thus, the pumped gas is cooled. As the first and second fins 306, 326 are integral (or at least attached to) with the first and second plates 300, 320 respectively, the heat transferred to the fins 306, 326 is transferred to the plates 300, 320. Also in operation, a cooling fluid (i.e. a gas or liquid coolant, such as water or water with an anti-corrosion additive) is caused to flow along the first and second channels 308, 328 formed in the first and second plates 300, 320 respectively. This flow of cooling fluid through the channels 308, 328 cools the plates. Thus, the heat that has been transferred from the pumped gas to the plates 300, 320 by the fins 306, 326 is removed from the plates.

In this embodiment, advantageously, cooling fluid is directly applied to the vacuum pump coolers 112, 114. This tends to provide for more effective heat transfer from the vacuum pump coolers 112, 114, and thus more effective cooling of the pumped gas.

The cooling fluid may flow into the first and second channels 308, 328 formed in the first and second plates 300, 320 from a cooling fluid source that is external to the multistage vacuum pump 100. The cooling fluid may flow out of the first and second channels 308, 328 formed in the first and second plates 300, 320 to a cooling fluid sink that is external to the multistage vacuum pump 100.

The above-described vacuum pump coolers provide "intercooling" of a pumped gas, i.e. cooling of a pumped gas at the interstage regions of the multistage vacuum pump.

The gas paths between sequential stages of the multistage Roots vacuum pump tends to be relatively long compared to other vacuum pumps, such as reversed-claw or screw machine pumps. The above-described vacuum pump coolers exploit these relatively long interstage gas paths or ducts to provide effective intercooling.

Advantageously, the improved cooling that tends to be provided by the above-described vacuum pump coolers tends to facilitate maintenance of a good working temperature of the pump and maintenance of correct clearances within the pump, and tends to ensure various components and working fluids operate as desired.

The improved cooling that tends to be provided by the above-described vacuum pump coolers tends to provide improved pumping performance and reliability.

Advantageously, the vacuum pump coolers are single-piece, monolithic entities formed of thermally conductive materials. Thus, use of smaller components, such as cooling tubes, which may be subject to fatigue failures when constructed of high conductive materials such as aluminium or copper tends to be avoided.

Advantageously, the above-described vacuum coolers avoid the use of pipes of a first material that are at least partially embedded in a supporting structure, such as a casting, of a second material. As such, the likelihood of thermally insulating air pockets between the two different materials tends to be eliminated. The above-described coolers may be formed substantially from a single material having a predetermined, or desired, thermal conductivity. Accordingly, the above-described vacuum pump coolers tend to provide improved thermal conductivity and consequently more effective cooling of the pumped fluid.

Advantageously, the above-described vacuum coolers tend to be robust to fatigue and breakage, for example caused by corrosive and/or high temperature gases being pumped by the vacuum pump.

The above-described vacuum pump coolers may be easily disassembled from the housing, for example for cleaning or inspection.

In the above embodiments, the multistage vacuum pump is a Roots vacuum pump. However, in other embodiments, the multistage vacuum pump is a different type of multistage vacuum pump, e.g. a multistage claw pump.

In the above embodiments, the multistage vacuum pump comprises two vacuum pump coolers. However, in other embodiments, the pump comprises a different number of vacuum pump coolers, such as only a single cooler, or more than two coolers. For example, in some embodiments, one of the first or second vacuum coolers is omitted and may be replaced with a standard or conventional housing wall.

In the above embodiments, the first vacuum pump cooler forms a top or upper wall of the housing. However, in other embodiments, the first vacuum cooler forms a different wall of the housing, such as a side wall of the housing.

In the above embodiments, the second vacuum pump cooler forms a bottom or lower wall of the housing. However, in other embodiments, the second vacuum cooler forms a different wall of the housing, such as a side wall of the housing.

In the above embodiments, the multistage vacuum pump comprises six stages. However, in other embodiments, the multistage vacuum pump comprises a different number of stages, i.e. fewer than six, or more than six.

In the above embodiments, each pumping stage comprises a respective pair of cooperating rotors. However, in other embodiments one or more or the pumping stages may comprise a different type of pumping mechanism, for example a pumping mechanism having a different number of rotors.

In the above embodiments, the rotors are three-lobed rotors. However, in other embodiments, one or more of the rotors has a different number of lobes, for example two lobes, or more than three lobes.

In the above embodiments, the first vacuum pump cooler comprises eight first fins. However, in other embodiments, the first vacuum pump cooler comprises a different number of first fins, for example fewer than eight, or more than eight. The number of fins of the first vacuum pump cooler may be application dependent, and may depend on factors including, but not limited to, the number of pumping stages and the dimensions of the interstage ducts.

In the above embodiments, the second vacuum pump cooler comprises thirteen second fins. However, in other embodiments, the second vacuum pump cooler comprises a different number of first fins, for example fewer than thirteen, or more than thirteen. The number of fins of the second vacuum pump cooler may be application dependent. The number of fins of the second vacuum pump cooler may depend on factors including, but not limited to, the number of pumping stages and the dimensions of the interstage ducts.

In the above embodiments, the first fins may be substantially U-shaped fins, i.e. may be considered to have substantially U-shaped cross-section. However, in other embodiments, one or more of the first fins has a different shape other than a U-shape.

In the above embodiments, the second fins may be substantially U-shaped fins, i.e. may be considered to have substantially U-shaped cross-section. However, in other embodiments, one or more of the second fins has a different shape other than a U-shape.

In the above embodiments, the first plate comprises a plurality of ports in which blow-off valves are received. However, in other embodiments, the first plate comprises a different number of port and blow-off valves to that shown in the Figures. In some embodiments, the ports and blow-off valves are omitted. In some embodiments, some or all of the ports and the blow-off valve are located on a different wall of the housing other than the first vacuum cooler, i.e. the top wall. For example, in other embodiments, one or more of the upstream end wall, the downstream end wall, the first side wall, the second side wall, and the bottom wall (i.e. the second vacuum cooler) may comprise one or more ports in which may be received respective blow-off valve.

In the above embodiments, the first and second plates each comprise a respective channel through which a cooling fluid is caused to flow. However, in other embodiments, one or both of the first and second plates comprises a different number of such channels, i.e. multiple channels. The channel or channels may have any appropriate shapes.

Figure 5:
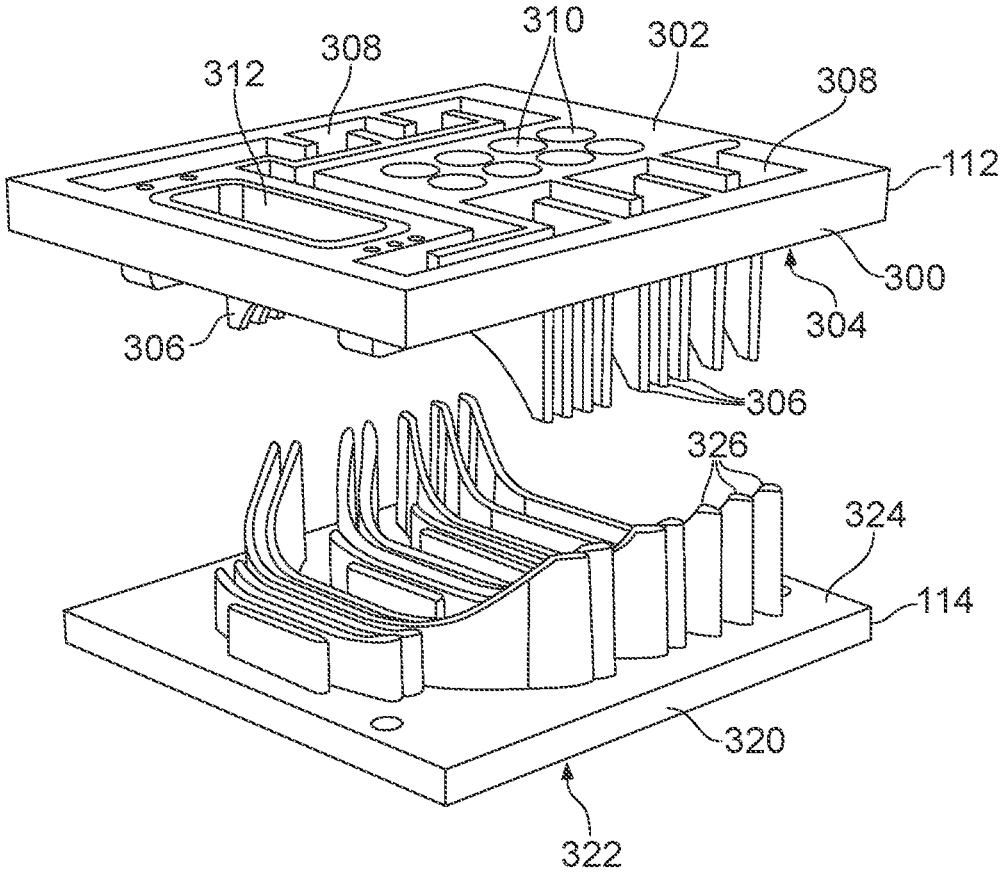
FIG. 5 is a schematic illustration (not to scale) showing a perspective view of the vacuum pump coolers.

Thus, one or both of the vacuum pump cooler may have a different shape or configuration to that described above. FIG. 5 is a schematic illustration showing the first and second vacuum pump coolers 112, 114 in accordance with a further embodiment. In the embodiment shown in FIG. 5, the number and shape of the fins 306, 326, the shape and configuration of the first channel 308, and the number and configuration of the ports 310 is different to that shown in FIGS. 3 and 4 and described above.

In the above embodiments, the cooling fluid channels are formed by recesses in the first surfaces of the first and second plates. However, in other embodiments at least a part of one or both of the channels is not formed by a recess in a surface of a vacuum pump cooler. For example, in some embodiments, one or more of the channel is a duct, tube or bore formed through a plate of a vacuum pump cooler. In some embodiments, a least a part of a channel of a vacuum pump cooler is a duct, tube or bore that extends into the body of one or more of the fins. In other words, at least a part of a channel may be formed in one or more of the fins. Accordingly, cooling fluid may be caused to flow through one or more of the fins. This tends to provide improved cooling of the fins and thus of the pumped gas.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A vacuum pump cooler for cooling a pumped fluid in a multistage vacuum pump, the vacuum pump cooler comprising:

a plate comprising:

a first surface;

a second surface opposite to the first surface;

an aperture extending between the first surface and the second surface, the aperture defining an inlet or outlet of the multistage vacuum pump;

a channel through which a cooling fluid can flow; and a fin extending from the second surface of the plate so that the fin extends further away from the second surface at an end of the fin than at a middle of the fin.

2. The vacuum pump cooler of claim 1, wherein the vacuum pump cooler comprises a plurality of fins and the fin is one of the plurality of fins.

3. The vacuum pump cooler of claim 1, wherein the channel is defined, at least in part, by a recess formed in the first surface.

4. The vacuum pump cooler of claim 3, wherein the channel defines a meandering pathway.

5. The vacuum pump cooler of claim 1, wherein at least a part of the channel is formed within a body of the fin.

6. The vacuum pump cooler of claim 1, wherein the fin has a substantially U-shaped cross-section.

7. The vacuum pump cooler of claim 1, wherein the plate further comprises a port, the port being configured to receive a blow-off valve.

8. The vacuum pump cooler of claim 1, wherein the vacuum pump cooler is a single unitary item.

9. The vacuum pump cooler of claim 1, wherein the vacuum pump cooler is formed from a material selected from the group of materials consisting of iron, alloys of iron, steel, anodised aluminium, and alloys of aluminium.

10. A multistage vacuum pump comprising:

a first stage having a first pumping chamber, the first pumping chamber having a first inlet and a first outlet;

a second stage having a second pumping chamber, the second pumping chamber having a second inlet and a second outlet;

an interstage duct fluidly coupling the first outlet and the second inlet; and a vacuum pumping cooler according to claim 1, wherein the vacuum pump cooler is arranged such that the one or more fins extend into the interstage duct.

11. The multistage vacuum pump of claim 10, further comprising a further vacuum pumping cooler, wherein the further vacuum pump cooler is arranged such that a fin of the further vacuum pumping cooler extends into the interstage duct.

12. The multistage vacuum pump of claim 11, wherein the vacuum pumping cooler and the further vacuum pumping cooler define opposite walls of a housing that houses the first stage, the second stage, and the interstage duct.

13. The multistage vacuum pump of claim 11, wherein:

the vacuum pumping cooler wherein the aperture extending between the first surface and the second surface of the vacuum pumping cooler defines the inlet of the multistage vacuum pump; and the further vacuum pumping cooler comprises a second aperture extending between a first surface and a second surface of the further vacuum pumping cooler, the second aperture defining the outlet of the multistage vacuum pump.

14. A vacuum pump cooler for cooling a pumped fluid in a multistage vacuum pump, the vacuum pump cooler comprising:

a plate comprising:

a first surface;

a second surface opposite to the first surface;

an aperture extending between the first surface and the second surface, the aperture defining an inlet or outlet of the vacuum pump;

a channel through which a cooling fluid can flow; and a fin extending from the second surface of the plate, wherein the channel is formed within a body of the fin.

* * * * *